US005691042A

United States Patent [19]

Goguelin et al.

[11] Patent Number: 5,691,042

[45] Date of Patent: Nov. 25, 1997

[54] PRINTABLE RIBBED COATED SHEET AND PROCESS FOR PRODUCING SAME

[75] Inventors: Michel Goguelin, Charavines; Emeric Thibierge, Asnieres; Alain Barthez, Paris, all of France

[73] Assignee: Arjo Wiggins S.A., Paris, France

[21] Appl. No.: 78,248

[22] PCT Filed: Dec. 20, 1991

[86] PCT No.: PCT/FR91/01047

§ 371 Date: Aug. 18, 1993

§ 102(e) Date: Aug. 18, 1993

[87] PCT Pub. No.: WO92/11413

PCT Pub. Date: Jul. 9, 1992

[30] Foreign Application Priority Data

Dec. 21, 1990 [FR] France ..... 90 16141

[51] Int. Cl.[6] ..... B32B 3/00

[52] U.S. Cl. ..... 428/211; 428/174; 428/195; 428/341; 428/500; 428/507; 428/521; 428/537.5; 427/256

[58] Field of Search ..... 156/78, 244.23, 156/244.24, 244.25, 307.7; 428/319.7, 204, 207, 412, 458, 480, 195, 481, 486, 537.5, 174, 211, 347, 500, 507, 521; 427/147, 209, 296, 256; 264/45.1; 162/70, 72, 109

[56] References Cited

U.S. PATENT DOCUMENTS

| | | | |
|---|---|---|---|
| 1,900,294 | 3/1933 | Lovatt . | |
| 4,957,578 | 9/1990 | Huffman et al. | 428/204 |
| 4,986,860 | 1/1991 | Akimoto et al. | 428/319.7 |

FOREIGN PATENT DOCUMENTS 377927 4/1931 Belgium .

OTHER PUBLICATIONS

JP 57 056212 Translation of patent, Apr. 1982.

World Patents Index Latest Week 8251, Sep. 24, 1971, Derwent Publications Ltd., AN 82-10862J.

*Primary Examiner*—William Krynski
*Attorney, Agent, or Firm*—Foley & Lardner

[57] ABSTRACT

The invention relates to a printable, coated, marked sheet which is formed by a marked base covered on at least one of its sides by at least one pigmented coating and more particularly a matt coating. The invention furthermore relates to the manufacturing process of such a sheet.

18 Claims, No Drawings

PRINTABLE RIBBED COATED SHEET AND PROCESS FOR PRODUCING SAME

The invention relates to a printable marked sheet which comprises at least one pigmented coating, and more particularly a matt coating. The invention furthermore relates to the manufacturing process of such a sheet.

In the present description the terms "marked sheet" and "marked paper" refer to a sheet or paper, respectively, which has relief marks or patterns made with the aid of embossing rollers or dandy rollers, or also with the aid of marking felts, possibly whilst hot. This includes, for example, a laid paper, the wire marks having been made with the aid of a dandy roller; a grained paper, the grain having been produced by means of an embossing roller or marking felt. It may likewise include unsmoothed, so-called "rough-machined" papers which have a certain structured surface (rustic effect) caused by markings on the felt of the paper machine. It may also include, for example, a film of embossed synthetic material.

Already known, according to a prior technique, are marked papers that can be used for offset printing. These papers may be grained or laid. However, they have a very mediocre printability and are unsuitable for four-colour printing. However, such papers are interesting because they present a great diversity of appearance conferred by the marking and a great diversity of feel.

Papers are known that comprise a pigmented coating so as to give them a good printability in particular for four-colour printing.

Also known are marked papers that comprise at least one pigmented coating to make them printable. Such papers are made by forming a sheet by the wet method, i.e. using an aqueous dispersion containing cellulose fibres, possibly with other natural, mineral and/or synthetic fibres, and possibly binders, colouring agents and other additives currently used in the paper industry. The aqueous dispersion is applied onto a metal screen, squeezed and then dried. The sheet obtained in this manner is then coated by means of coaters with compounds that contain fillers (e.g. kaolin). Then the coated sheet is dried. Finally, the sheet is marked outside the machine.

Such papers, because they are marked after they have been coated, have as their main drawback that the graining operation makes the coating shiny at the places where pressure is exerted via the relief on the embossing or dandy rollers or the relief on the marking felts. Furthermore, the appearance of the paper made in this manner is reminiscent of synthetic paper and the rigidity of the paper is badly affected. These papers, therefore, have shinny and unaesthetic spots or streaks.

It is, therefore, an object of the invention to provide a marked paper which has a good printability (i.e. is coated), but which at the same time retains the rigidity of a not marked paper, of the same weight and which has a homogeneous matt appearance. It is, therefore, an object of the invention to provide a paper of the type suitable for printing and/or writing, which is matt, but at the same time marked.

Consequently, it is an object of the invention to provide a paper which combines the advantages of the two types of paper and which avoids their drawbacks: a coated paper which, therefore, has a better printability with a soft marking which ensures originality without detracting from the homogeneity of the glossiness and without affecting the rigidity.

Another object of the invention is to provide a coated grained paper which has a good rigidity and will prevent the user from buying a paper with a considerably higher weight (the choice of the weight of the paper being, in fact, often linked to the rigidity required by the user).

The applicant has made such a printable, coated, marked and matt sheet, the surface appearance of which (i.e. the mattness or the glossiness) is homogeneous and not affected by the marking, by first of all carrying out the marking of a base and by covering at least one side of this base with at least one pigmented coating.

The process for making such a sheet according to the present invention contradicts the preconceptions of the person skilled in the art.

Thus, until now, the skilled person had thought that if a pigmented coating was applied to a paper which had beforehand been marked, the coating would fill up the hollow parts and that, therefore, after the coating the marks would no longer be visible. Furthermore, the skilled person thought that the coating would not be distributed in a homogeneous manner, the hollow parts filling up more and the embossed parts being coated only slightly by the coating compound.

The invention, therefore, relates to a printable, coated, marked sheet, which is formed by a marked base covered on at least one of its sides by at least one pigmented coating.

According to one embodiment of the invention, the pigmented coating has a mass of between 5 and 30 g/m$^2$ when dry, and in particular between 10 and 20 g/m$^2$.

Preferably, the pigmented coating is matt. More preferably, the base is a grained, laid paper.

The invention furthermore relates to a manufacturing process for a printable, coated, marked sheet, wherein successively a flexible base is formed, marks are made on at least one of the sides of this base by creating hollows and bumps, then, at least one pigmented compound is applied to at least one of the sides of this base, and the sheet obtained in this manner is dried.

According to a preferred embodiment of the invention, the flexible base is formed by applying onto a metal fabric an aqueous dispersion of cellulose fibres, possibly mixed with other natural fibres, synthetic, mineral fibres and possibly other additives such as binders, pigments, retention agents, flocculation agents, optical brighteners, colourants etc. The base may essentially consist of synthetic fibres.

The base may also be made from polyethylene or its mixtures which are drawn bi-axially.

According to the invention, any pigmented coating can be used. However, a matt pigmented coating is preferred; the degree of mattness can be more or less high.

The base may be marked during manufacture on the machine or outside the machine by any marking device: embossing rollers, dandy rollers, marking felts, etc. The marking may possibly be carried out hot, in particular for synthetic bases.

The base may be coated with any coating device normally used in the paper industry. One may advantageously use an air knife coater or a coater of the Bill-Blade type. The coating is applied to one or both the sides of the base.

The printable sheet according to the invention can advantageously be made completely on a paper machine, i.e. without carrying out operations outside the machine which would increase the production costs.

The sheet obtained according to the invention can be used for numerous applications, e.g. in the printing and/or writing field, for packaging, labels, etc.

The following non-limitative examples will provide a better understanding of how the invention can be put into practice.

COMPARATIVE EXAMPLES

Example A according to the prior technique: a paper is coated with a matt coating consisting of:

40 parts of kaolin 60 parts of calcium carbonate 10 parts of acrylic latex.

This paper is grained with a graining roller.

The obtained paper has shiny spots and a synthetic feel. Example B according to the invention: On the machine a paper is made which is grained with a graining felt. The grained base is coated with the same compound used for example A.

The paper obtained in this manner has retained its grained appearance, but has neither shiny spots nor a synthetic feel. From table 1, which lists the comparative physical characteristics, it is noted that the rigidity of the paper according to the invention is superior to that of the paper according to the prior technique. N.B.: The TABER rigidity is measured according to standard ISO 2493 (1973). The weight and the swelling index are determined according to standard ISO 534 (1988) .

The ash content is determined according to standard ISO 2144 (1987).

TABLE 1

| | EXAMPLES | |
|---|---|---|
| | A | B |
| Dry weight of coating ($g/m^2$) | 20 | 19 |
| Weight of paper ($g/m^2$) | 114 | 117 |
| Swelling index (cm3/g) | 1.00 | 1.21 |
| Ash content at 420° C. (dry in air) % | 25 | 24.5 |
| TABER rigidity (g.cm) | | |
| Travelling direction | 3.0 | 3.9 |
| Transverse direction | 1.5 | 2.6 |

Example 1

One prepares a matt pigmented coating in an aqueous medium, with the following composition, when dry:

| | |
|---|---|
| calcium carbonate | 55 parts |
| kaolin | 45 parts |

To these 100 parts of filler one adds 20 parts of a mixture of carboxylated styrene-butadiene latex binder and starch and a small amount of optical brightener to give the coating a great whiteness.

The dry extract of the compound is 60%.

As a base for the coating, a laid paper is used, sold by the applicant under the trade mark RIVES COLOR CLASSIC, which is a laid paper obtained by a dandy roller. The weight of this paper is 90 $g/m^2$. The paper has a grey colour.

This base is coated with the above pigmented compound with the aid o a rotating HAND COATING bar. The weight of the applied coating is 12 $g/m^2$ dry.

The fact that the base is grey and the coating has a great whiteness produces a contrast which permits one to verify that the coating has been applied in a uniform manner.

It is noted that the wire marks are still well visible. Moreover, the sheet obtained in this manner has a good printability, very close to that of non-laid coated papers. Furthermore, the sheet has a rigidity equivalent to that of a coated paper of the same weight. Finally, the sheet has a non-synthetic feel.

Example 2

Used as a base is a grained paper sold by the applicant under the trade mark RIVES COLOR DESIGN with a weight of 120 $g/m^2$ and a grey colour.

This base is coated with the pigmented compound of example 1. The weight of the coating is 18 $g/m^2$ dry.

As in example 1, it is seen that the coating has been applied in a homogeneous manner, and it is noted that the obtained paper still has well visible grains. Furthermore, the sheet has a good printability and a rigidity comparable to that of a non-grained coated paper. The paper does not have any shiny spots due to the grain.

Example 3

A paper is made (of cellulose fibres) on a FOUDRINIER paper machine without smoothing it. It is coated by means of an air knife with the compound of example 1.

The weight of the layer when dry is 12 $g/m^2$.

The sheet coated in this manner has retained ins unsmoothed (so-called "rustic") surface, but its printability has improved compared to the uncoated paper.

We claim:

1. A pigment-coated offset printing paper comprising a base material made of cellulose fibers and having at least one marked side with hollow and embossed portions and a pigment coating directly on at least one of the marked sides of the base material that uniformly coats the hollow and embossed portions but does not fill up the hollow portions, whereby the paper retains a marked appearance.

2. A pigment-coated printing paper as claimed in claim 1, which has a matte surface appearance on the pigment-coated side.

3. A pigment-coated printing paper as claimed in claim 1, wherein the pigment coating comprises a carboxylated styrene-butadiene latex.

4. A pigment-coated printing paper as claimed in claim 1, wherein the pigment coating comprises an acrylic latex.

5. A pigment-coated printing paper as claimed in claim 1, wherein the mass of the pigment coating is between about 5 and 30 $g/m^2$ when dry.

6. A pigment-coated printing paper as claimed in claim 1, wherein the mass of the pigment coating is between 10 and 20 $g/m^2$ when dry.

7. A pigment-coated printing paper as claimed in claim 1, wherein the base material is selected from the group consisting of grained papers, laid papers, and rough-machined papers.

8. A pigment-coated printing paper as claimed in claim 1, which is printed on at least one pigment-coated side.

9. A pigment-coated printing paper as claimed in claim 1, wherein the base material is a grained paper.

10. A pigment-coated printing paper as claimed in claim 1, wherein the base material is a laid paper.

11. A pigment-coated printing paper as claimed in claim 1, which comprises a pigment coating on both sides of the base material.

12. A pigment-coated printing paper as claimed in claim 1, wherein the pigment coating comprises one or both of calcium carbonate and kaolin.

13. A method of printing that comprises using the pigment-coated printing paper as claimed in claim 1.

14. A method as claimed in claim 13, wherein the printing is offset printing.

15. A packaging material or label comprising a pigment-coated printing paper as claimed in claim 1.

16. A process for manufacturing a pigment-coated printing paper as claimed in claim 1, comprising forming a flexible base material; marking the base material on at least one of its sides; optionally drying the marked base material; applying to at least one of the marked sides of the marked base material a pigment coating, and drying the obtained sheet.

17. A process as claimed in claim 16, wherein the marked base material is selected from the group consisting of grained papers, laid papers, and rough-machined papers.

18. A process as claimed in claim 16, wherein the marking is accomplished by the use of embossing rollers, dandy rollers, or marking felts.

* * * * *